US005695366A

United States Patent [19]

Tomczak et al.

[11] Patent Number: 5,695,366

[45] Date of Patent: Dec. 9, 1997

[54] SHIELDED ELECTRICAL CONNECTOR

[75] Inventors: Gary L. Tomczak, Woodridge; David L. Brunker; Gordon W. Funck, both of Naperville, all of Ill.; David Christopher Musial, Conway, Ark.

[73] Assignee: Molex Incorporated, Lisle, Ill.

[21] Appl. No.: 593,640

[22] Filed: Jan. 29, 1996

[51] Int. Cl.[6] ..... H01R 13/648

[52] U.S. Cl. ..... 439/607

[58] Field of Search ..... 439/607, 608, 439/609, 92, 95

[56] References Cited

U.S. PATENT DOCUMENTS

| | | | |
|---|---|---|---|
| 4,337,989 | 7/1982 | Asick et al. . | |
| 4,386,819 | 6/1983 | Asick et al. . | |
| 4,449,778 | 5/1984 | Lane . | |
| 4,585,292 | 4/1986 | Frantz et al. . | |
| 4,653,836 | 3/1987 | Peele . | |
| 4,689,723 | 8/1987 | Myers et al. | 361/424 |
| 4,789,357 | 12/1988 | Yamaguchi et al. | 439/607 |
| 5,199,903 | 4/1993 | Asick et al. | 439/610 |
| 5,281,169 | 1/1994 | Kist et al. | 439/607 |
| 5,358,428 | 10/1994 | Bixler et al. | 439/607 |

*Primary Examiner*—Khiem Nguyen
*Attorney, Agent, or Firm*—Charles S. Cohen

[57] ABSTRACT

A shielded electrical connector includes an elongated dielectric housing having opposite ends and a plurality of transverse extending terminal-receiving cavities. A pair of elongated metal shells have narrow elongated flanges interfacing at a longitudinal seam. At least one shell includes a tab projecting from the flange thereof into an opening in the flange of the other shell. The tab is are bent in the longitudinal direction behind the flange of the other shell.

10 Claims, 4 Drawing Sheets

SHIELDED ELECTRICAL CONNECTOR

FIELD OF THE INVENTION

This invention generally relates to the art of electrical connectors and, particularly, to a shielded electrical connector having a pair of shield halves secured together along an elongated seam.

BACKGROUND OF THE INVENTION

Shielded electrical connectors are used in various applications for shielding electrical interconnections from external electromagnetic interference, to prevent the systems which use the connectors from emitting electromagnetic signals and to prevent the connectors, themselves, from emitting electromagnetic signals or noise. In some applications involving the use of high frequency electrical signals, shielded electrical connectors are industry requirements, particularly in such applications as the telecommunications and computer industries. Such high frequency signals are very susceptible to interference from other electromagnetic signals and also generate electromagnetic signals of their own which may be undesirable and interfere with other electronic devices.

The design considerations for shielded electrical connectors are similar to those for general electromagnetic shielded enclosures. The connector, or at least the electrical interconnections, must be substantially surrounded by a metallic barrier. Seams in the connector must be protected from electromagnetic leakage by sufficient metal-to-metal contact between the adjacent components at the seams. In general, any openings in a shielding shell must be kept to a minimum and limited in size to prevent leakage. Of course, other factors including metal thickness, conductivity, permeability, type of field and distance from an interference source to the field must be considered in designing shielded connectors.

One type of shielded electrical connector, commonly referred to as an input/output (I/O) connector, has a dielectric housing with a plurality of terminal-receiving cavities extending in a direction between opposing mating and terminating faces of the connector. A pair of shield halves or metal shells are joined at an interface or seam and substantially surround the dielectric housing. The shells often have oppositely projecting portions, such as generally D-shaped shrouds, projecting from and/or defining the mating and terminating faces of the connector. As long as the two shield halves or shells are securely connected at the interface or seam, adequate protection is provided for the ingress or egress of electromagnetic interference.

However, with the ever-increasing miniaturization of electrical connectors in various industries, such as the telecommunications and computer industries, along with the ever-increasing number of circuits to be accommodated by a single electrical connector, the above-mentioned design considerations for shielded connectors have become difficult to maintain. For instance, I/O connectors of the character described above have become increasingly elongated because of the increasing number of circuits accommodated by the connectors. Of course, this requires the shield halves to become correspondingly elongated, resulting in rather long interfaces or seams between the shield halves. The long seams have a tendency to open and allow electromagnetic interference leakage. The shield halves or shells often have peripheral flanges substantially about the perimeter of the connector. These flanges most often provide the means for closing any open seams. However, with the ever-increasing miniaturization of these electrical connectors, the flanges have become quite narrow, thereby providing little material from which securing means can be formed. The present invention is directed to solving these conflicting problems in a shielded electrical connector of the type having a pair of interengageable metal shield halves or shells.

SUMMARY OF THE INVENTION

An object, therefore, of the invention is to provide a new and improved shielded electrical connector of the character described.

In the exemplary embodiment of the invention, the shielded electrical connector includes an elongated dielectric housing having opposite ends and a plurality of transverse terminal-receiving cavities extending between opposing mating and terminating faces of the connector. A pair of elongated metal shells substantially surround the dielectric housing and abut each other at a longitudinal peripheral seam. Each shell includes flange means and a shroud projecting from the flange means at a respective one of the mating and terminating faces. The flange means of the shells interface at the seam. The flange means of each shell include narrow flanges extending longitudinally on opposite sides of the shroud and wide flanges at opposite ends of the shroud projecting from the opposite ends of the housing. At least one shell includes a tab projecting from at least one narrow flange thereof into a notch in one of the narrow flanges of the other shell. The tab is bent in the longitudinal direction behind the one narrow flange of the other shell.

As disclosed herein, a plurality of the tabs may project from both of the narrow flanges on opposite sides of the shroud of the one metal shell into a plurality of notches in the narrow flanges of the other metal shell. At least one shell includes a tab projecting from at least one wide flange thereof and bent in the transverse direction behind one of the wide flanges of the other shell. The shells comprise drawn metal components.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
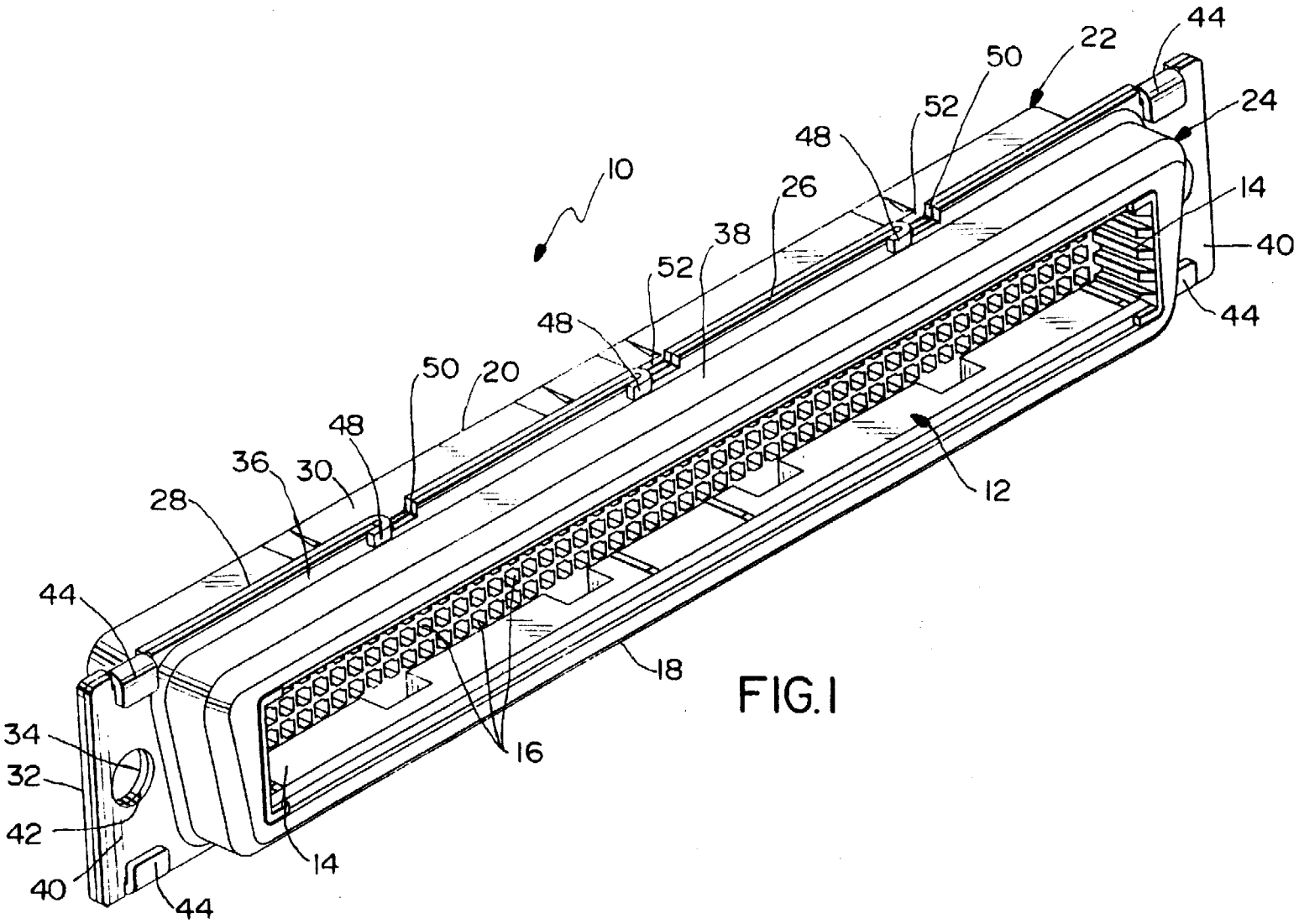
FIG. 1 is a rear left perspective view of a shielded electrical connector embodying the concepts of the invention.
Figure 4:
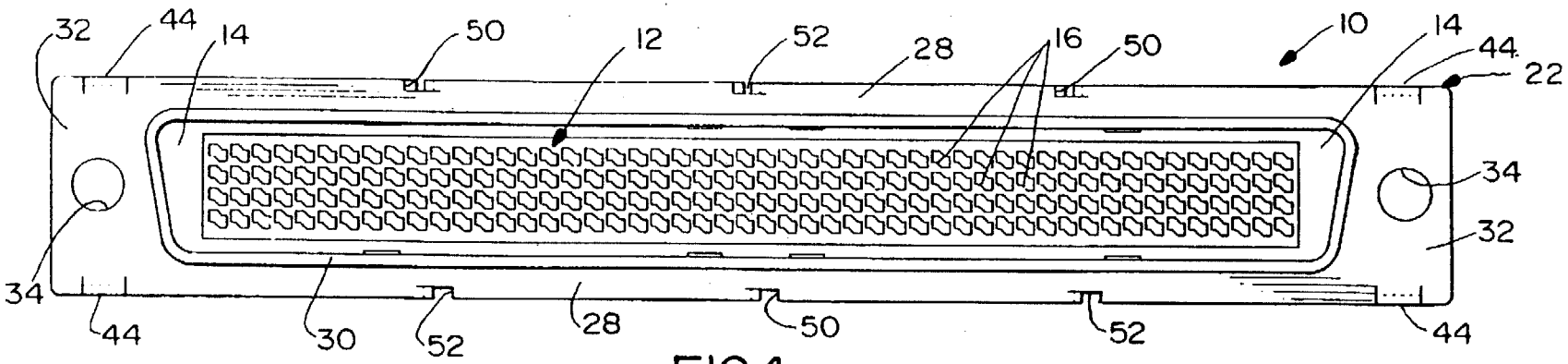
FIG. 4 is a front elevational view of the connector.

Referring to the drawings in greater detail, and first to FIGS. 1–4, the invention is embodied in a shielded electrical connector, generally designated 10. The connector includes a dielectric housing, generally designated 12. It can be seen that the housing 12 is considerably elongated between opposite ends 14. The housing has a plurality of transverse terminal-receiving cavities 16 extending in a direction between opposing terminating and mating faces 18 and 20, respectively, of the connector. The housing is unitarily molded of dielectric material such as plastic or the like. The terminals are not depicted in the drawings.

Figure 6:
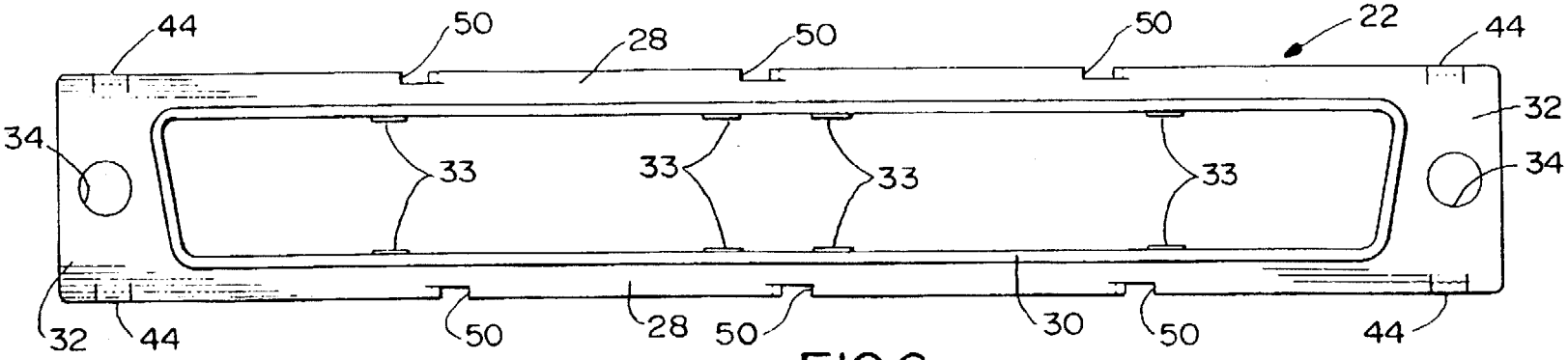
FIG. 6 is a front elevational view of the shell shown in FIG. 5.
Figure 7:
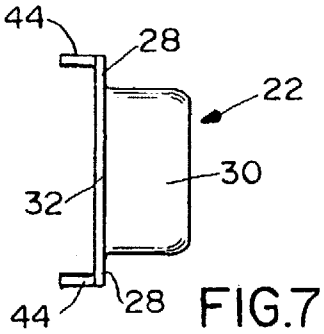
FIG. 7 is an end elevational view of the shell shown in FIGS. 5 and 6.
Figure 5:
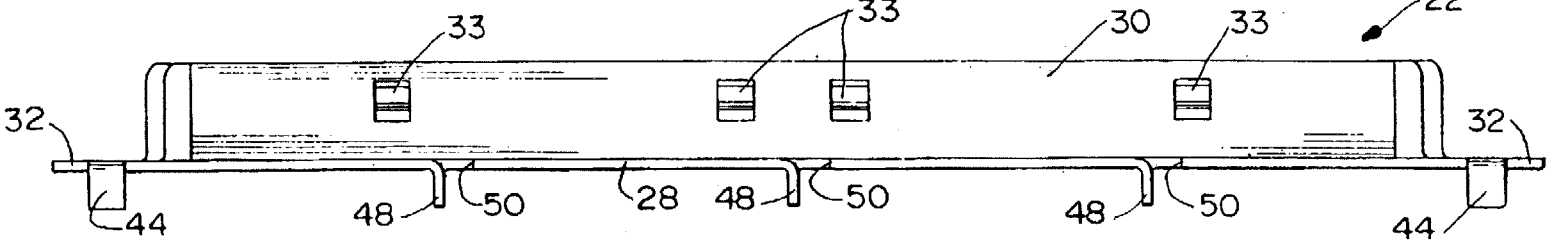
FIG. 5 is a plan view showing the metal shell comprising the front mating portion of the connector.
Figure 8:
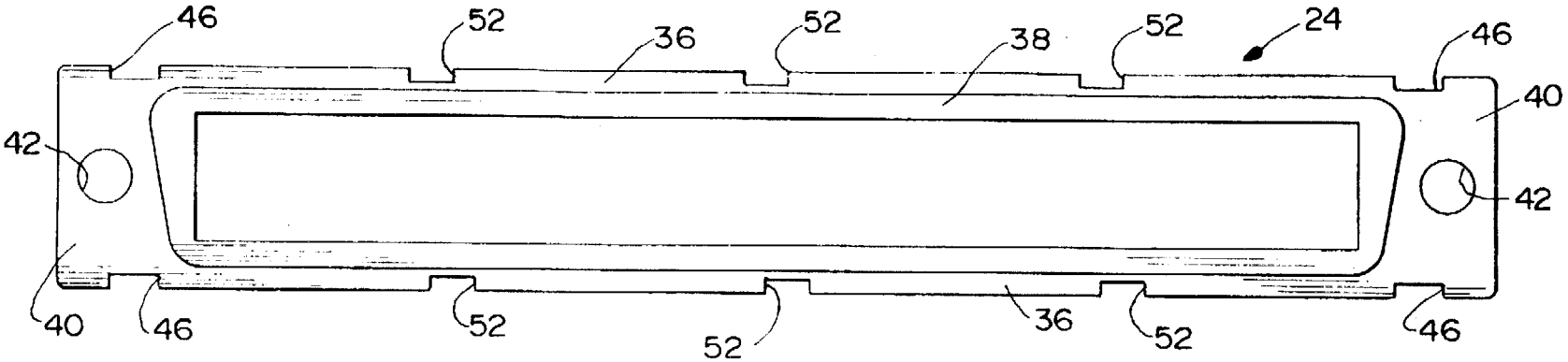
FIG. 8 is an elevational view of the other shell comprising the rear portion of the connector.
Figure 9:
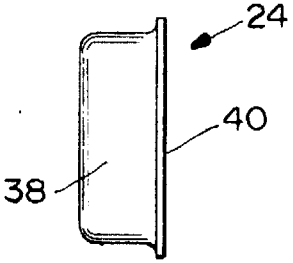
FIG. 9 is an end elevational view of the shell shown in FIG. 8.

Shielded electrical connector 10 includes a pair of elongated metal shells, generally designated 22 and 24, which substantially surround dielectric housing 12 and abut each other at a longitudinal peripheral seam 26. The shells are formed as drawn metal components. FIGS. 5–7 show metal shell 22 which is the front shell in FIGS. 1 and 2 that defines the front mating face 20 of connector 10. FIGS. 8 and 9 show shell 24 which is the rear shell in FIGS. 1 and 2 that defines the rear terminating face 18 of the connector. Generally, the shells have flange means interfacing at seam 26.

More particularly, referring to FIGS. 5–7 in conjunction with FIGS. 1–4, front shell 22 includes a pair of narrow flanges 28 extending on opposite sides of a shroud 30 and a pair of wide end flanges 32 at opposite ends of the shroud and which project from opposite ends 14 of housing 12. In essence, shroud 30 defines rear terminating face 20 of the connector. The shroud has inwardly formed dimples 33. Wide end flanges 32 have apertures 34 to facilitate mounting the connector to an appropriate support structure, other connector or the like.

Figure 3:
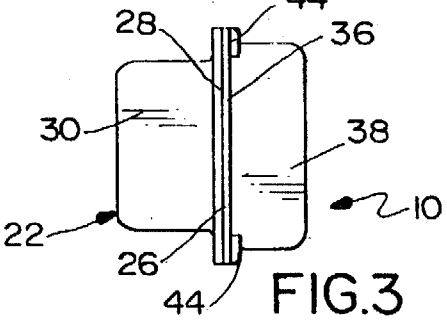
FIG. 3 is an end elevational view of the connector.
Figure 2:
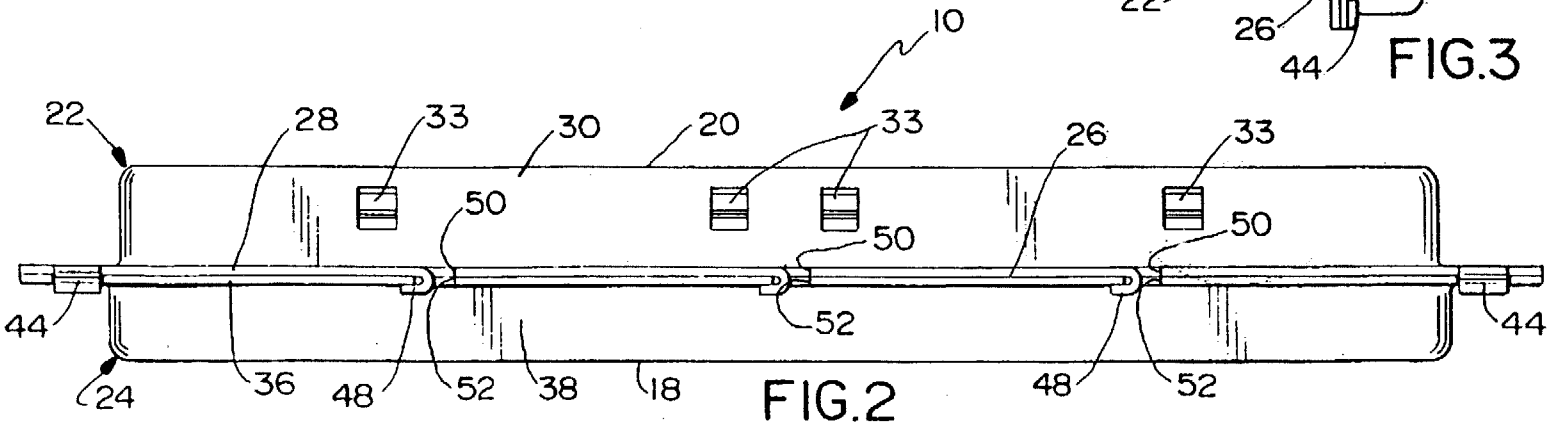
FIG. 2 is a top plan view of the connector as viewed in FIG. 1.

Similarly, referring to FIGS. 8 and 9 in conjunction with FIGS. 1–3, rear shell 24 includes a pair of narrow flanges 36 extending longitudinally on opposite sides of a shroud 38 and a pair of wide end flanges 40 at opposite ends of the shroud and projecting from opposite ends of housing 12. Apertures 42 are formed in wide end flanges 40 and are alignable with apertures 34 in wide flanges 32 of front shell 22 for the purposes described above.

In accordance with one aspect of the invention, to secure shells 22 and 24 together at seam 26, front shell 22 has a pair of tabs 44 projecting from opposite sides of each wide end flange 32 and which project into notches 46 in opposite sides of wide end flanges 40 of rear shell 24. These tabs 44 are initially bent inwardly in a direction generally perpendicular to flange 32 and away from shroud 30. Once shells 22 and 24 are positioned together, tabs 44 are bent behind wide flanges 40 of rear shell 24 as shown best in FIGS. 1–3.

In accordance with another aspect of the invention, a plurality of tabs 48 are formed out of cutouts 50 (FIGS. 5 and 6) in narrow flanges 28 of front shell 22. Upon assembling shells 22 and 24, the tabs 48 project through notches 52 in narrow flanges 36 of rear shell 24. It can be seen best in FIGS. 1 and 2 that tabs 48 are then bent in the longitudinal direction behind narrow flanges 36 of the rear shell 24 to securely connect the two shells together both mechanically and electrically along the longitudinal seam 26 between the shells.

In assembly, front shell 22 is drawn and formed as shown in FIGS. 5–7, and rear shell 24 is drawn and formed as shown in FIGS. 8 and 9. Unitarily molded dielectric housing 12 having terminals (not shown) is inserted into rear shell 24. Front shell 22 then is assembled to the rear shell 24 about the housing 12 with the flange means 28, 36 of the shells in abutting relationship. The size of the shroud 30 is slightly smaller than the housing 12 in order to retain the housing between the shells 22 and 24. During assembly, end tabs 44 of front shell 22 pass through notches 46 of rear shell 24, and side tabs 48 of the front shell 22 pass through notches 52 of the rear shell 24. After the shells are juxtaposed at an interface defined at seam 26 by the flange means of the shells, end tabs 44 are bent inwardly in the transverse direction behind wide flanges 40 of the rear shell 24, and side tabs 48 are bent in the longitudinal direction behind narrow flanges 36 of the rear shell 24. The connector now is fully assembled and dielectric housing 12, along with the terminals therewithin, are effectively shielded from the ingress or egress of electromagnetic interference.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A shielded electrical connector, comprising:

an elongated dielectric housing having opposite ends and a plurality of transverse terminal-receiving cavities extending between opposing mating and terminating faces of the connector; and a pair of elongated metal shells substantially surrounding the dielectric housing and abutting each other at a longitudinal peripheral seam, each shell including flange means and a shroud projecting from the flange means at a respective one of the mating and terminating faces, the flange means of the shells interfacing at said seam, the flange means of each shell including narrow flanges extending longitudinally on opposite sides of the respective shroud, wide flanges at opposite ends of the shroud projecting from said opposite ends of the housing, at least one shell including a tab projecting from at least one narrow flange thereof into a notch in one of the narrow flanges of the other shell, the tab being bent in the longitudinal direction behind said one narrow flange of the other shell and at least one shell including a tab projecting from at least one wide flange thereof and bent in the transverse direction behind one of the wide flanges of the other shell.

2. The shielded electrical connector of claim 1 wherein each of said shells comprises a drawn metal component.

3. The shielded electrical connector of claim 1, including a plurality of tabs projecting from both of the narrow flanges on opposite sides of the shroud of one of the metal shells and into respective ones of a plurality of notches in the narrow flanges of the other metal shell, said tabs being bent in the longitudinal direction behind the respective narrow flanges of the other metal shell.

4. A shielded electrical connector, comprising:

an elongated dielectric housing having opposite ends and a plurality of transversely extending terminal-receiving cavities; and a pair of elongated metal shells having narrow elongated flanges interfacing at a longitudinal seam and wide flanges at opposite ends of the metal shells, at least one shell including a tab projecting from at least one narrow flange thereof into an opening in the narrow flange of the other shell, the tab being bent in the longitudinal direction behind the flange of the other shell and at least one shell including a tab projecting from at least one wide flange into an opening in the wide flange of the other shell and bent in the transverse direction behind one of the wide flanges of the other shell.

5. The shielded electrical connector of claim 5, including a plurality of said tabs projecting from the flange of the one shell into a plurality of said openings in the flange of the other shell.

6. A shielded electrical connector, comprising:

an elongated dielectric housing having opposite ends and a plurality of transverse terminal-receiving cavities extending between opposing mating and terminating faces of the connector; and a pair of elongated metal shells substantially surrounding the dielectric housing and abutting each other at a longitudinal peripheral seam, the shells being drawn metal components, each shell including flange means and a shroud projecting from the flange means, the flange means of the shells interfacing at said seam, the flange means of each shell including wide flanges at opposite ends of the shroud projecting from said opposite ends of the housing, first and second narrow flanges extending longitudinally on opposite sides of the respective shroud and between said wide flanges, at least one shell including a plurality of first tabs projecting from said first narrow flange thereof into a plurality of notches in the first narrow flange of the other shell, said first tabs being bent in the longitudinal direction behind the first narrow flange of the other shell, at least one shell including a plurality of second tabs projecting from the wide flanges thereof, and the second tabs being bent in the transverse direction behind the wide flanges of the other shell.

7. The shielded electrical connector of claim 6 wherein said first tabs are formed out of cutouts in the narrow flanges of the one shell.

8. The shielded electrical connector of claim 7 wherein one of said shells includes a plurality of third tabs projecting from said second narrow flange thereof into a plurality of notches in the second narrow flange of the other shell, said third tabs being bent in the longitudinal direction behind the second narrow flange of the other shell.

9. A method of assembling a shielded electrical connector comprising the steps of:

providing an elongated dielectric housing having opposite ends and a plurality of transverse terminal-receiving cavities extending between opposing mating and terminating faces of the connector;

providing a pair of elongated metal shells, each shell including flange means and a shroud projecting from the flange means at a respective one of the mating and terminating faces, the flange means of each shell including narrow flanges extending longitudinally on opposite sides of the respective shroud and wide flanges at opposite ends of the shroud projecting from said opposite ends of the housing, one shell including a tab projecting from at least one narrow flange thereof, the other of said shells including a first notch in one of the narrow flanges;

aligning said first tab of said one shell with said first notch of the other of said shells, positioning the shells to substantially surround the dielectric housing and abut each other at a longitudinal peripheral seam between the shells with the tab being inserted into said notch, bending said tab in a longitudinal direction behind said one narrow flange of the other shell at least one shell includes a second tab projecting from at least one wide flange thereof, and said method includes the step of bending said tab in a transverse direction behind one of the wide flanges of the other shell.

10. The method of claim 9, wherein said one shell includes a plurality of said tabs projecting from both of the narrow flanges on opposite sides of the shroud of the one metal shell and the other metal shell includes a plurality of said notches in the narrow flanges on opposite sides of the shroud of the other metal shell, said aligning step further comprises aligning all of said tabs with a respective one of said notches, said positioning step further comprises inserting all of said tabs into their respective notches, and said bending step further comprises bending all of said tabs in a longitudinal direction behind one of said narrow flanges of the other shell.

* * * * *